United States Patent [19]

Nicholson

[11] 4,089,079

[45] May 16, 1978

[54] ROTARY WASHING BRUSH DEVICE

[75] Inventor: Lincoln E. Nicholson, Brooklyn, N.Y.

[73] Assignee: The Raymond Lee Organization, Inc., New York, N.Y. ; a part interest

[21] Appl. No.: 721,079

[22] Filed: Sep. 7, 1976

[51] Int. Cl.[2] ..... A46B 13/06
[52] U.S. Cl. ..... 15/29
[58] Field of Search ..... 15/24, 29, 50 R, 50 C

[56] References Cited

U.S. PATENT DOCUMENTS

| | | | |
|---|---|---|---|
| 1,604,500 | 10/1926 | Tannenbaum | 15/29 |
| 1,673,094 | | Stack | 15/29 |
| 2,678,457 | 5/1954 | Demo et al. | 15/29 |

FOREIGN PATENT DOCUMENTS

| | | | |
|---|---|---|---|
| 1,031,993 | 3/1953 | France | 15/29 |
| 1,565,296 | 3/1969 | France | 15/29 |

*Primary Examiner*—Edward L. Roberts
*Attorney, Agent, or Firm*—Daniel Jay Tick

[57] ABSTRACT

A housing has an inlet opening and a plurality of mutually spaced outlet openings spaced from the inlet opening. The housing has watertight ducts extending from the inlet opening to the outlet openings whereby water under pressure supplied to the inlet opening is provided at the outlet openings. A brush is rotatably mounted on the housing at the outlet openings in a manner whereby water from the outlet openings is provided around the brush. A hydro motor in the housing is coupled to the brush whereby a flow of water through the ducts rotates the hydro motor and thereby rotates the brush.

3 Claims, 3 Drawing Figures

ROTARY WASHING BRUSH DEVICE

BACKGROUND OF THE INVENTION

The present invention relates to a rotary washing brush device.

Objects of the invention are to provide a rotary washing brush device of simple structure, which is inexpensive in manufacture, used with facility and convenience, and functions efficiently, effectively and reliably as a cleaning brush, and especially as a bath brush.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 3:
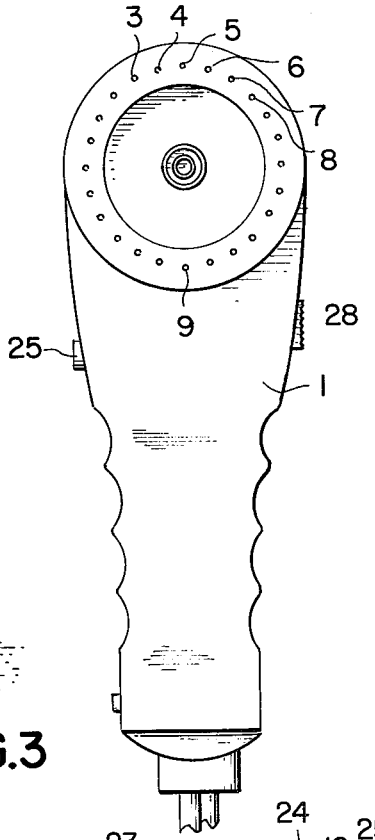
FIG. 3 is a view, on an enlarged scale, of the embodiment of FIG. 1.
Figure 2:
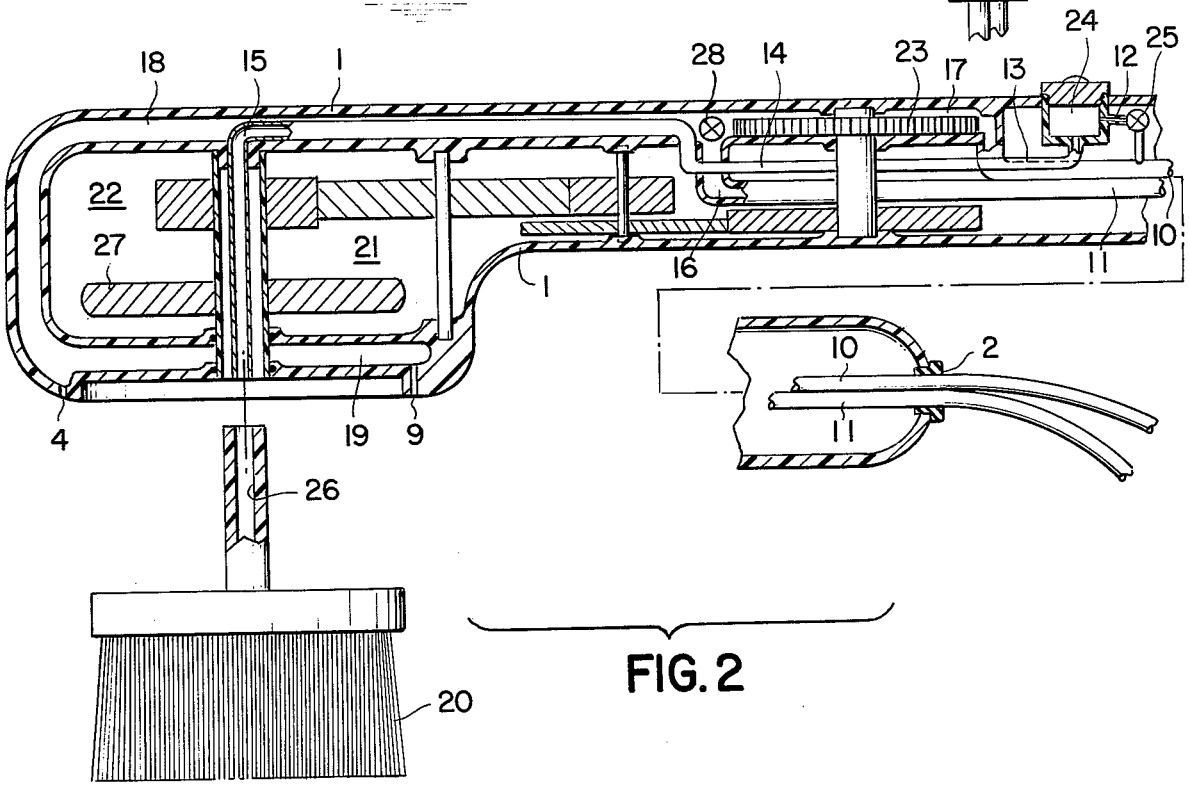
FIG. 2 is a view, partly in section, on an enlarged scale, and partly exploded, of the embodiment of FIG. 1.

The rotary washing brush device of the invention comprises a housing 1 having an inlet opening 2 (FIG. 2) and a plurality of mutually spaced outlet openings 3, 4, 5, 6. 7, 8, 9, and so on (FIG. 3) spaced from the inlet opening. The housing 1 has watertight ducts 10, 11, 12, 13, 14, 15, 16, 17, 18 and 19 extending from the inlet opening 2 to the outlet openings 3 to 9, and so on, as shown in FIG. 2, whereby water under pressure supplied to the inlet opening is provided at the outlet openings.

Figure 1:
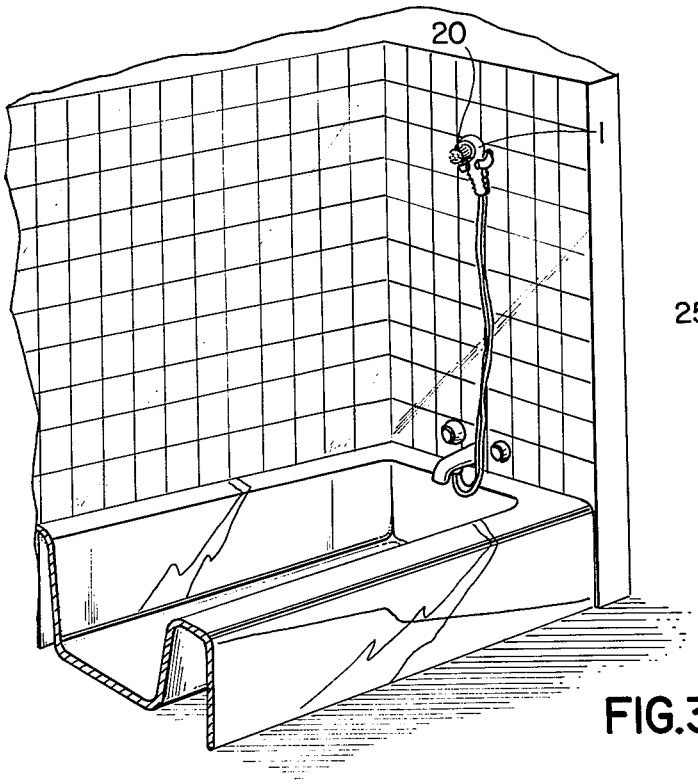
FIG. 1 is a perspective view of an embodiment of the rotary washing brush device of the invention in stored position.

A brush 20 is rotatably mounted on the housing 1 (FIGS. 1 and 2) at the outlet openings 3 to 9, and so on, in a manner whereby water from the outlet openings is provided around the brush. Thus, the outlet openings 3 to 9, and so on, are positioned in a circle having a diameter greater than that of the brush 20 and the brush is coaxially positioned within the circle of the outlet openings, whereby the outlet openings provide a circular spray around the brush.

The device has a watertight compartment 22 in the area 21 of the housing 1 (FIG. 2) and a hydro motor 23 in the watertight compartment 17. The hydro motor 23 is coupled to the brush 20 via coupled gears and thereby rotates said brush. The flow of water through the ducts 10 to 16, 18 and 19 rotates the hydro motor 23 in the watertight compartment 17. The watertight compartment has an inlet opening in communication with the duct extending from the housing inlet opening and an outlet communicating with the duct extending to the housing outlet openings.

A soap container 24 of liquid soap is provided. The ducts 13, 14 and 15 function as soap ducts and extend through the housing 1 between the watertight ducts and the soap container 24 and extend from said soap container 24 to the brush 20. A soap valve 25 in the soap duct 13 between the soap container 24 and the watertight ducts and is (FIGS. 2 and 3) is controllable from outside the housing 1 and controls the flow of water into the soap container via the ducts 10 and 12, and thereby controls the water and soap mixture out of the soap container at the brush 20.

The brush 20 has a hollow shaft 26 (FIG. 2) rotatably mounted at the soap duct 15. The brush 20 is driven by the hydro motor 23 via the hollow shaft 26 of said brush and said shaft continues to rotate by means of a flywheel 27 affixed to the said shaft.

A water flow control valve 28 (FIGS. 2 and 3) is provided in the duct 16 and is controllable from outside the housing 1 for controlling the pressure of water provided at the outlet openings 3 to 9, and so on, thereby controlling the intensity of the spray provided via said outlet openings. The valve 28 controls the flow of water through the ducts 16 and 18. The valve 28 permits the control of the water through the outlet openings 3 to 9 in an entire range from a spray-like shower with the brush rotating to no spray, but with the brush rotating.

The duct 10 is an inlet duct and the duct 11 is a return duct when the valve 28 is closed.

The device may be used as a shower, via the outlet openings 3 to 9, and so on, when the brush 20 and its shaft 26 are removed. The brush 20 and its shaft 26 are freely exchangeable, so that different people may use their own brushes.

While the invention has been described by means of a specific example and in a specific embodiment, I do not wish to be limited thereto, for obvious modifications will occur to those skilled in the art without departing from the spirit and scope of the invention.

I claim:

1. A rotary washing brush shower device, comprising a housing having an inlet opening and a plurality of mutually spaced outlet openings spaced from the inlet opening, said housing having watertight duct means extending from the inlet opening to the outlet openings whereby water under pressure supplied to the inlet opening is provided at the outlet openings;

a brush having a hollow shaft rotatably mounted on the housing at the outlet openings in a manner whereby water from the outlet openings is provided around the brush, said hollow shaft being removably mounted in the housing;

a watertight compartment in the housing having an inlet opening in communication with the duct means extending from the housing inlet opening and an outlet communicating with the duct means extending to the housing outlet openings;

hydro motor means in the watertight compartment in the housing at the inlet opening and coupled to the brush whereby a flow of water through the duct means rotates the hydro motor means and thereby rotates the brush; and a flywheel mounted on the hollow shaft and rotatable therewith for continuing the rotation of said shaft.

2. A rotary washing brush shower device as claimed in claim 1, further comprising a soap container of liquid soap, soap duct means extending through the housing between the watertight duct means and the soap container and extending from the soap container to the brush, and soap valve means in the soap duct means between the soap container and the watertight duct means, said soap valve means being controllable from outside the housing for controlling the flow of water into the soap container and the water and soap mixture out of the soap container at the brush.

3. A rotary washing brush shower device as claimed in claim 1, further comprising water flow control valve means in the duct means controllable from outside the housing for controlling the pressure of water provided at the outlet openings.

* * * * *